United States Patent [19]

Lower et al.

[11] Patent Number: 5,069,778

[45] Date of Patent: Dec. 3, 1991

[54] SCREEN DECK WITH PEDESTAL MOUNTED SLATS

[75] Inventors: William E. Lower, Cincinnati; Stephen C. Mitchell, West Chester, both of Ohio

[73] Assignee: Rotex, Inc., Cincinnati, Ohio

[21] Appl. No.: 611,835

[22] Filed: Nov. 13, 1990

[51] Int. Cl.[5] ..... B07B 1/28

[52] U.S. Cl. ..... 209/323; 209/395; 209/405; 209/674

[58] Field of Search ..... 209/323, 382, 393, 394, 209/395, 396, 405, 409, 674, 675, 676, 680

[56] References Cited

U.S. PATENT DOCUMENTS

| | | | |
|---|---|---|---|
| 2,112,367 | 3/1938 | Hyter | 209/396 X |
| 3,381,355 | 5/1968 | Bixby | 209/395 X |
| 3,506,123 | 4/1970 | Ranger | 209/395 |
| 3,805,955 | 4/1974 | Bixby et al. | 209/395 |
| 4,504,386 | 3/1985 | Dyren et al. | 209/254 |
| 4,558,787 | 12/1985 | Danielsson et al. | 209/626 |
| 4,664,790 | 5/1987 | Lundqvist | 209/395 |
| 4,802,591 | 2/1989 | Lower et al. | 209/680 |

FOREIGN PATENT DOCUMENTS 814542 6/1959 United Kingdom .

*Primary Examiner*—Donald T. Hajec
*Assistant Examiner*—Joseph A. Kaufman
*Attorney, Agent, or Firm*—Wood, Herron & Evans

[57] ABSTRACT

A screen deck having spaced, canted parallel slats which present screening slots between them, wherein the slats are mounted on pedestals that are positioned and aligned by parallel rods which extend transversely through the pedestals. The pedestals are spaced apart by spacers between them, the spacers being held in place by the rods. Slat mounting is facilitated and slot width uniformity is improved by use of the pedestals.

16 Claims, 3 Drawing Sheets

SCREEN DECK WITH PEDESTAL MOUNTED SLATS

FIELD OF THE INVENTION

This invention relates to screening machines, and more particularly to means for accurately mounting and spacing a series of parallel canted slats in a screen deck so that elongated slots of uniform width are presented between the slats.

BACKGROUND OF THE INVENTION

Lower et al Pat. No. 4,802,591, titled "Louvered Chip Screener" discloses a machine and method for separating chip-like particles according to thickness, wherein the deck of the machine comprises a series of spaced flexible "louvers" or slats which extend parallel to the direction of chip flow on the deck. The slats are canted (tilted) transversely to the direction of the flow and present elongated slot-like chip openings between them. The slats are supported in a frame by a series of pedestals or posts mounted on cross-members in the frame. The pedestals have bases which are secured on the cross-members, and upstanding legs or backs with angulated tops onto which the slats are secured. Screening machines of the "louver" type are especially useful because they provide low blinding and high efficiency at high throughput in sustained screening use.

In practice, however, it has been found relatively difficult to precisely align the pedestals on the cross-members so that the width of slots between slats secured on the angulated tops is as uniform as might be desired. For example, in one chip screener it is desirable to maintain a width tolerance of no more than 0.5 mm in a nominal 9 mm slot. The slot width determines the maximum thickness of the chips which fall through; variation in slot width from slot to slot, or along the length of a given slot, blurs the separation of the fractions. One major cause of non-uniformity of slot width is variation in pedestal position and alignment. Such screen decks usually have a welded aluminum frame, and in practice the frame members often "bow" somewhat so that the pedestal bases do not all lie in a common plane, as a result of which the pedestals are not in straight rows. Further, it is difficult to secure the pedestal bases to the cross members in precise positions (for example as by riveting). Slight mis-spacings, non-planarity or "cocking" of pedestals are reflected as variations in slot width.

Thus, there has been a need for a better means of positioning and mounting the slats of slat-type screeners.

SUMMARY OF THE INVENTION

In accordance with this invention the slats are mounted on slat support means comprising pedestals which are aligned by and on sets of parallel rods that pass transversely through the pedestals. Each rod is secured between frame side members. The pedestals are spaced apart along each rod set by spacers between them, and form a column on the rod set. The spacers are preferably right cylindrical sections of tube having end faces which engage the upright portions (backs) of the pedestals. The rods, which preferably pass through correspondingly dimensioned holes in the pedestal backs, align the pedestals in columns and in vertical planes. The spacers position the pedestals longitudinally along the rods and preferably are captured between the rods which pass through each pedestal. The rods extend across the deck, transversely to the slats; the pedestals of the several rod sets form longitudinal rows to which the slats are secured. The pedestals can be punched from sheet metal with good dimensional control; and the spacers can be machined to accurate lengths with squared (perpendicular) end faces. The pedestals are "strung" on and supported by the rods, and need not be riveted or otherwise secured to a base. Such forming and positioning provides much more uniform slot width than was previously feasible in commercial machines.

DESCRIPTION OF THE DRAWINGS

The invention can best be further described by reference to the accompanying drawings in which.

DETAILED DESCRIPTION

Figure 1:
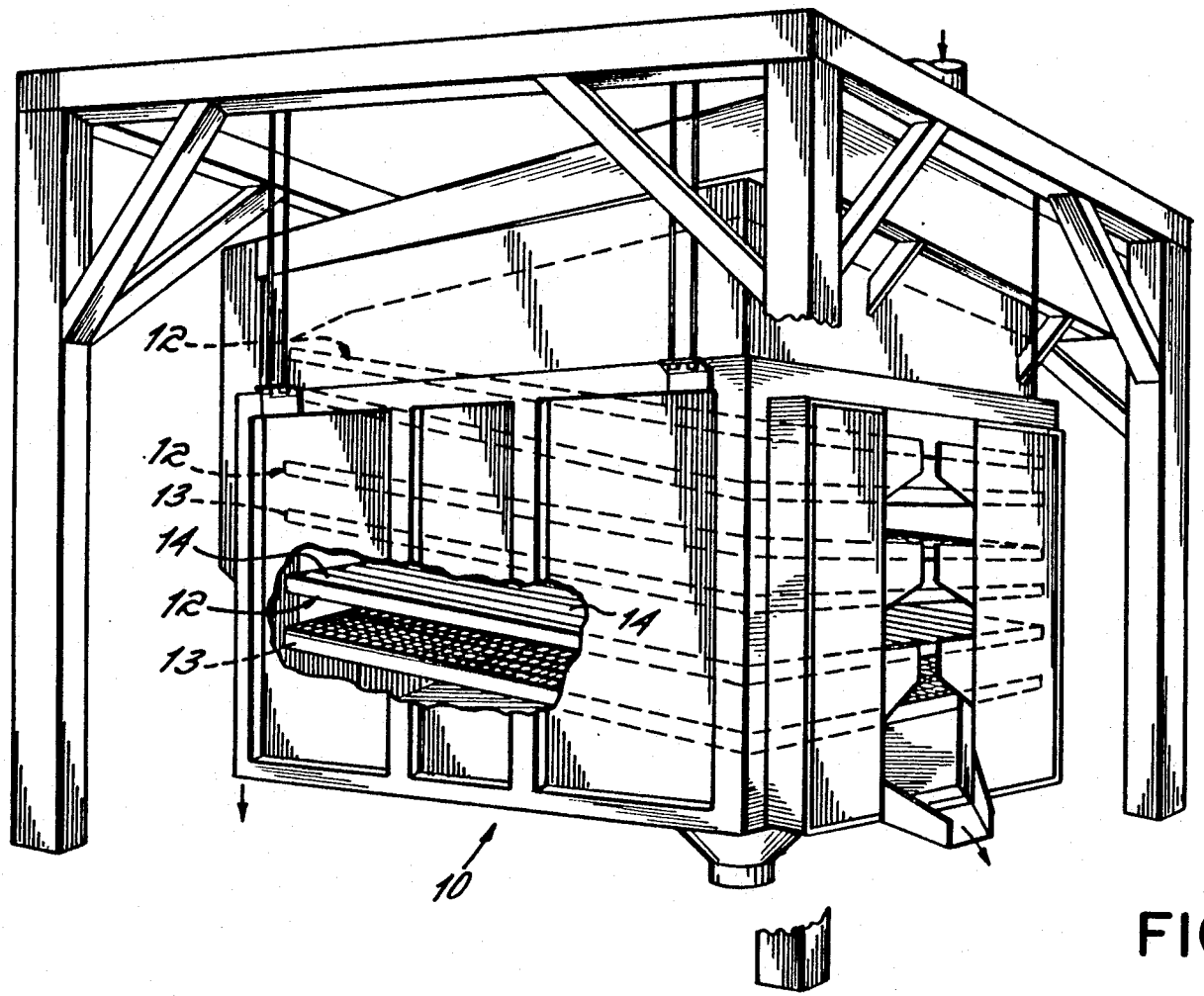
FIG. 1 is a perspective view, partly broken away, of one type of slat-type multiple screen deck in which the slat mounting means of the invention may be used.

FIG. 1 illustrates one type of screening machine in which decks in accordance with the present invention may be utilized. The screener shown in the figure is a multiple deck chip screener 10 having a stack of three pairs of decks, each pair comprising a louvered deck 12 over a screen deck 13. Each louvered deck 12 may be in accordance with the principles of this invention. Further details of that general type of screener may be as set forth in previously identified Pat. No. 4,802,591.

Figure 2:
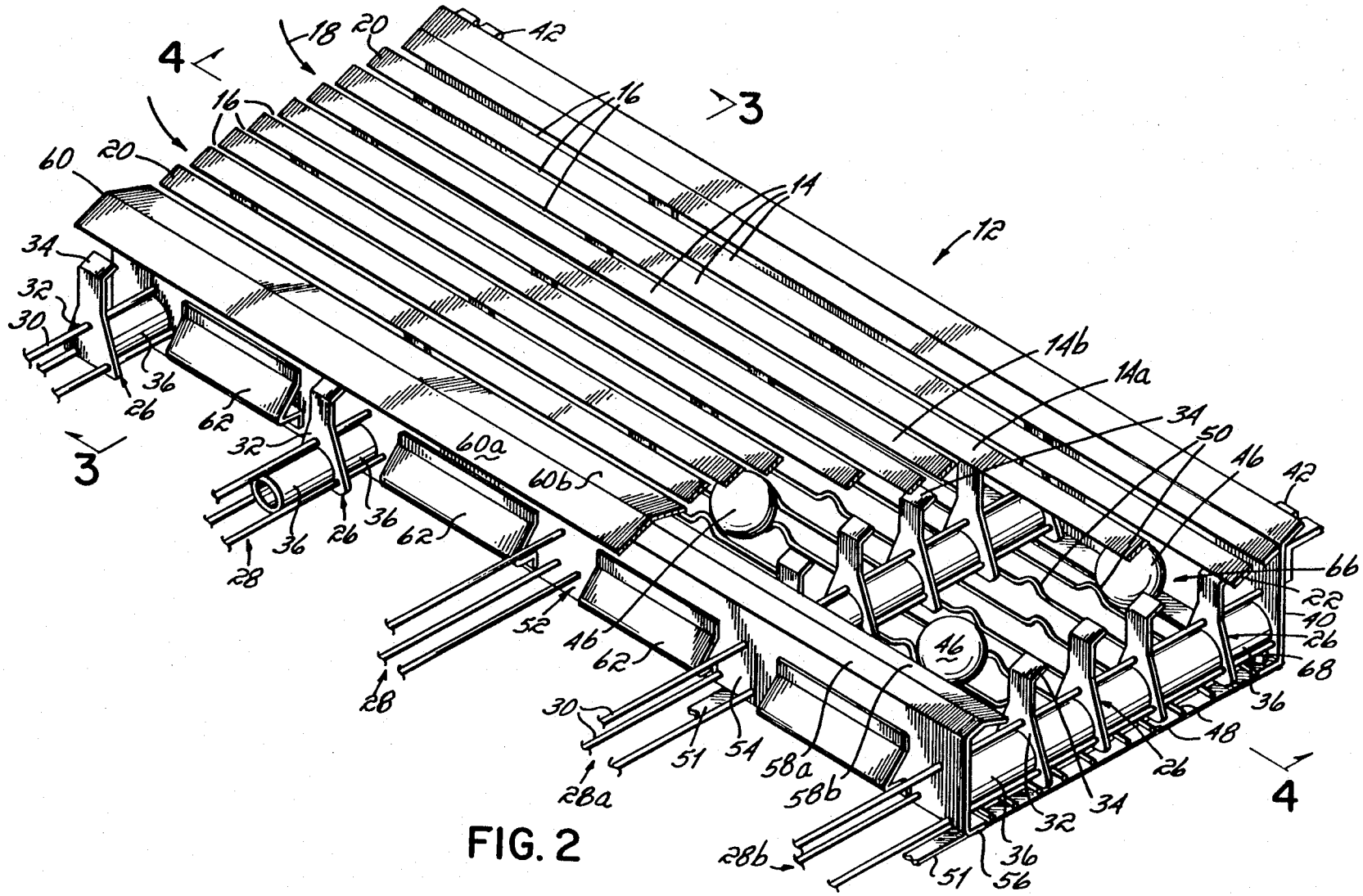
FIG. 2 is an enlarged perspective view, partly broken away, of a screen deck in accordance with a preferred embodiment of the invention.
Figure 3:
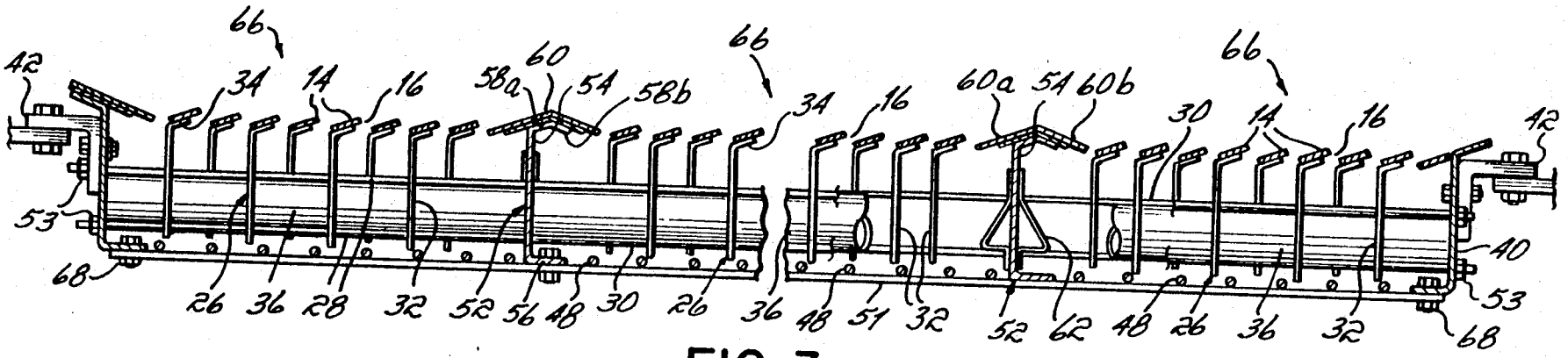
FIG. 3 is a transverse section taken on line 3—3 of FIG. 2.

Referring to FIG. 2, the individual deck 12 has a series of parallel slats, each designated by 14, which define chip-separating slots 16 between them. The slats and slots extend parallel to the direction of chip flow, indicated by the arrows 18, from an upper end 20 to the lower end 22 of the deck. The slats 14 are canted or tilted as viewed in a transverse section (FIG. 3). In accordance with the invention, the slats 14 are mounted by slat support means in the form of pedestals or posts, each designated by 26. The pedestals 26 are carried on sets 28 of rods 30, each set preferably comprising three rods as in the embodiment shown in the drawings.

Figure 4:
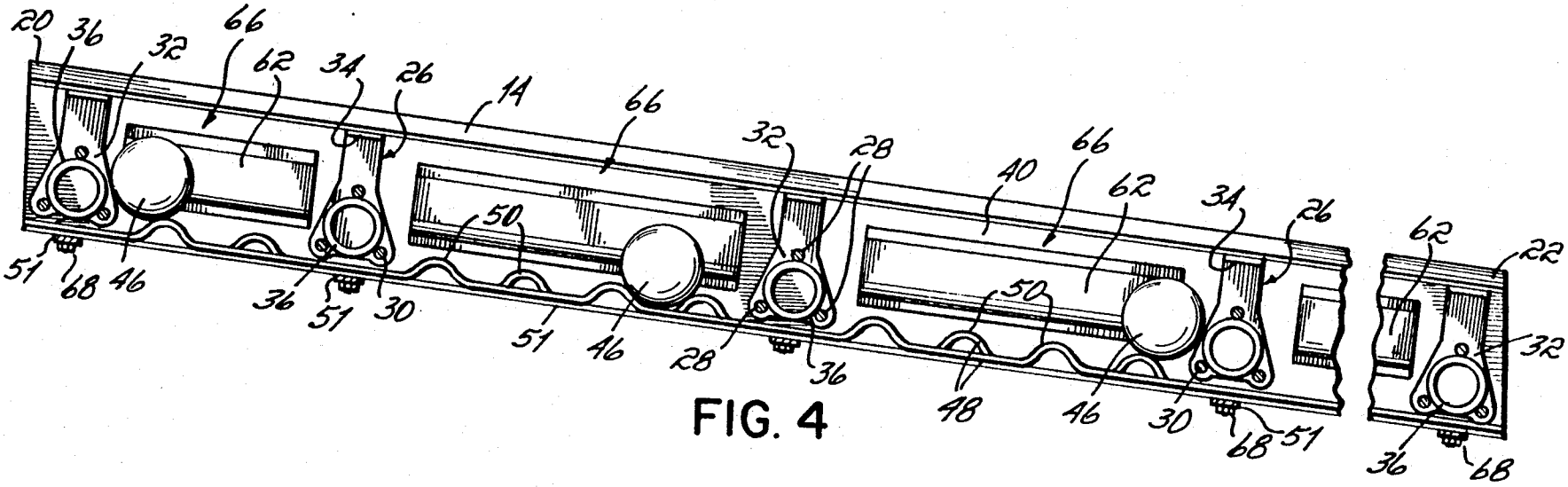
FIG. 4 is a longitudinal section view taken on line 4—4 of FIG. 2.

As best seen in FIG. 4, the three rods 30 of each set 28, viewed in cross section, lie along the edges of an imaginary triangular prism. Each pedestal 26 comprises a flat or planar upright back portion 32 with a tab 34 at the top bent angularly to the back 32, to which a slat 16 is secured as by welding. The back 32 of the pedestal 26 is roughly triangular in outline shape and preferably has three alignment apertures in the form of holes through which the three respective rods 30 pass. The apertures snugly receive the rods 30 so that the pedestals can be slid into position along the rods; they are held at predetermined distances apart on the rods 30 by the spacers to be described. The set 28 of rods aligns the pedestals in a column along it.

The pedestals 26 are spaced apart from one another, by spacers 36 between them. The spacers 36 are preferably right cylindrical sections of hollow tube, having perpendicular end faces. Each spacer is small enough in diameter that it can be received and retained in the middle of the triangular prism defined by the rods. Alternatively, one or more rods may pass through the centers of the spacers 36, but this does not so precisely hold the spacers in axial alignment. The perpendicular end faces of the spacers abut the faces of the pedestal backs 32 and thereby insure that the pedestals will be at right angles to the rods 30, so that corresponding pedestals of different rod sets form longitudinal rows. The pedestals may for example be stamped from 11 gauge steel, and the rod holes cut by laser drilling. The spacers may be formed from 1⅜" diameter steel tube having end faces machined to perpendicularity.

At their ends the rods 30 of each set 28 pass through frame side members 40 of the deck and are secured as by bolts 53 (FIG. 3) to form a unitary assembly. The rods 30 clamp the spacers 36 and pedestals 26 together and prevent relative movement. The side members 40 of the deck have mounting flanges 42 by which they may be secured in the screening machine 10.

The slats 14 are mounted to the tops 34 of the pedestals 26, transversely to the rods 30. As shown in FIG. 2, the pedestals 26 of adjacent rod sets are staggered so that adjacent slats are attached to the pedestals of different sets. That is, slat 14*a* is mounted to a pedestal in rod set 28*a*, but the adjacent slat 14*b* is not; slat 14*b* is mounted to rod set 28*b* instead. The mounting of adjacent slats to pedestals of different sets of rods permits relative vibrational flexing of adjacent slats along their entire length. At the position where a slat 14 is fixed to a pedestal, it cannot vibrate under impact of a slot cleaner; if adjacent slats 14*a*, 14*b* were supported by pedestals of the same column, neither would be able to vibrate at the pedestals and thus a chip stuck in the slot at that point would be less likely to be dislodged. Since adjacent slats 14*a*, 14*b* are supported at staggered positions along their lengths, at least one of them can flex at any given lengthwise position. This permits clearing of chips stuck in the slots between slats, even at the pedestals.

The deck 12 preferably includes slot cleaning or clearing means in the form of a series of balls 46 in ball cages or chambers 66 below the slats. The balls are supported and retained in their chambers 66 on ball support wires 48. Undulations 50 formed at intervals along the support wires 48 cause the balls 46 to bounce angularly and irregularly upwardly when the machine is operating. Further description of cleaning means is given in previously identified Pat. No. 4,802,591. The support wires 48 are mounted to cross straps 51 which in turn are secured to bottom flanges of side members 40. Balls 46 can easily be replaced by loosening bolts 68 (FIG. 3) which connect the cross straps 51 to the side frame members 40.

As seen in FIGS. 2 and 3, longitudinal dividers or stringers 52 extend from one end of the deck 12 to the other, parallel to the side members 40. These dividers provide side walls for the ball cages or chambers 66. The rods 30 of each set 28 pass through openings in each divider, and the spacers 36 abut opposite sides of the dividers. Each divider 52 comprises an upright web 54, a bottom flange 56, a top flange 58*a* which extends outwardly at the same angle and in the same plane as the tabs 34 of the pedestals, and a downturned outer top flange 58*b*. Angulated ball deflectors in the form of bevel strips 62 are secured to the webs 54 of the dividers 52 in the ball chambers 66 between the rod sets. Like the undulations 50, the deflectors direct the balls angularly upwardly as the deck is operated so that the balls bounce randomly against the slats above the chamber. The upwardly angulated "prism" formed by the rods of the sets also helps to deflect the balls upwardly (see FIG. 4).

An elongated inverted V-shaped roof 60 is mounted to the top flange 58 of each divider 52. Roof 60 has one side 60*a* which lies in a plane parallel to the planes of the slats 14, and an opposite side 60*b* which lies at the same but opposite angle. The balls 46 could not impact on a slot 16 closer to the web 54 than their own radius; such a slot would be a "dead zone" which would not be subject to the cleaning action of the balls. For that reason roof sides 60*a* and 60*b* space the slots along them outwardly from the divider sufficiently to provide a good cleaning action. The width of the roof sides 60*a* and 60*b* precludes chip clogging close to the dividers.

In assembling the deck 12, the rods 30 of each set 28 are passed through a divider, a spacer 36 is set between the rods 30, a pedestal 26 is slipped along the rods up to the spacer 36, then an additional spacer is inserted, and so on, through another divider, and so on across the width of the deck. The rods of each set are passed through the side frame member and are bolted to clamp the spacers, pedestals and dividers between the side members. The deck can then be set into the machine and bolted in place. This construction greatly facilitates and improves the preciseness of the pedestal positions. The pedestals 26 need not be secured to cross members, but rather are held squarely in place on rods in tension, and are clamped by the spacers at precisely desired spacings on the rods.

Measurements have shown that it is far easier to achieve acceptable uniformity of slot width between slats mounted in accordance with this invention as compared to the pedestal mounts shown in the previously identified patent.

Having described the invention, what is claimed is:

1. A screen deck comprising, frame members, a series of spaced, canted parallel slats, and slat support means mounting and positioning said slats so that slots are presented between the slats, said support means comprising, a plurality of sets of parallel rods extending between said frame members, transversely to said slats, a plurality of pedestals aligned by and carried on the rods of each set, said slats being mounted by the respective pedestals, each pedestal having a back presenting at least two alignment apertures through which pass the rods of the respective set, the pedestals on each set of rods being spaced from each other along said rods by spacers between the backs of the pedestals, the spacers positioning said pedestals perpendicularly to the rods and in rows transverse to the rod sets, and means clamping the pedestals and spacers in such positions relative to said frame members.

2. The screen deck of claim 1 wherein said spacers have perpendicular end faces which facially engage the backs of the pedestals.

3. The screen deck of claim 1 wherein said spacers are sections of hollow tube having perpendicular end faces.

4. The screen deck of claim 1 wherein said spacers are confined between the rods of the respective set.

5. The screen deck of claim 1 wherein the aligning apertures of all the pedestals on each rod set are similarly positioned on the pedestals, so that the pedestals are aligned as a column in the rod set.

6. The screen deck of claim 1 wherein said alignment apertures are holes in the backs of said pedestals, said holes having diameters substantially equal to the diameters of said rods, said rods fitting snugly through said holes and thereby positioning the pedestals in alignment.

7. The screen deck of claim 6 wherein said pedestals are produced by punching.

8. The screen deck of claim 6 wherein said holes are cut by laser.

9. The screen deck of claim 1 wherein each pedestal has a top extending at an angle to said back, a slat being secured to said top.

10. The screen deck of claim 1 wherein adjacent slats are not secured to pedestals on the same set of rods, said adjacent slats being mounted on pedestals staggered on different sets of rods.

11. The screen deck of claim 1 further including slot cleaning means.

12. The screen deck of claim 1 further including dividers transverse to said sets of rods, said rods passing through said dividers.

13. The screen deck of claim 12 wherein said dividers define walls of chambers for slot cleaning means.

14. The screen deck of claim 13 wherein ball deflectors are mounted to said dividers.

15. The screen deck of claim 1 wherein each set of rods comprises three rods, and said pedestals have three openings for the rods of said set, said openings being in a triangular array.

16. The screen deck of claim 1 wherein said frame members are parallel, said rods extend perpendicularly between said frame members, and said slats extend parallel to said frame members.

* * * * *